US011652278B2

(12) United States Patent
Zimmerman et al.

(10) Patent No.: US 11,652,278 B2
(45) Date of Patent: May 16, 2023

(54) MODULAR TYPE CELLULAR ANTENNA ASSEMBLY

(71) Applicant: CommScope Technologies LLC, Hickory, NC (US)

(72) Inventors: Martin Zimmerman, Chicago, IL (US); Troy Inslee Vanderhoof, McKinney, TX (US); Peter Bisiules, La Grange Park, IL (US)

(73) Assignee: CommScope Technologies LLC, Hickory, NC (US)

( * ) Notice: Subject to any disclaimer, the term of this patent is extended or adjusted under 35 U.S.C. 154(b) by 384 days.

(21) Appl. No.: 16/690,438

(22) Filed: Nov. 21, 2019

(65) Prior Publication Data

US 2020/0091591 A1 Mar. 19, 2020
US 2020/0091591 A1 Mar. 19, 2020

Related U.S. Application Data

(63) Continuation of application No. 15/425,685, filed on Feb. 6, 2017, now abandoned, which is a continuation
(Continued)

(51) Int. Cl.
*H01Q 1/24* (2006.01)
*H01Q 1/42* (2006.01)
(Continued)

(52) U.S. Cl.
CPC ..... *H01Q 1/246* (2013.01); *H01Q 1/24* (2013.01); *H01Q 1/42* (2013.01); *H01Q 9/04* (2013.01);
(Continued)

(58) Field of Classification Search
CPC ..... H01Q 21/00; H01Q 21/08; H01Q 15/14; H01Q 3/2658; H01Q 15/141; H01Q 21/26;
(Continued)

(56) References Cited

U.S. PATENT DOCUMENTS 4,594,285 A 6/1986 Osawa et al.
5,757,246 A 5/1998 Johnson
(Continued)

FOREIGN PATENT DOCUMENTS

DE 10 2007 033 817 12/2008
DE 20 2009 001 821 5/2009
(Continued)

OTHER PUBLICATIONS

Merriam-Webster, https://www.merriam-webster.com/dictionary/integral (accessed Sep. 8, 2022).*
(Continued)

*Primary Examiner* — Hai V Tran
(74) *Attorney, Agent, or Firm* — Myers Bigel, P.A.

(57) ABSTRACT

An individually formed radiating unit, an antenna array, and an antenna assembly are provided. The individually formed radiating unit includes a reflector, at least one radiating element integrated into a first side of the reflector, and a housing disposed on a second side of the reflector. The housing forms a chamber for housing a feed network

19 Claims, 10 Drawing Sheets

Related U.S. Application Data of application No. 13/393,492, filed as application No. PCT/US2010/047157 on Aug. 30, 2010, now Pat. No. 9,590,317.

(60) Provisional application No. 61/238,588, filed on Aug. 31, 2009.

(51) Int. Cl.

| | |
|---|---|
| ***H01Q 21/08*** | (2006.01) |
| ***H01Q 21/26*** | (2006.01) |
| ***H01Q 21/00*** | (2006.01) |
| ***H01Q 9/04*** | (2006.01) |
| ***H01Q 15/14*** | (2006.01) |

(52) U.S. Cl.
CPC ..... *H01Q 9/0478* (2013.01); *H01Q 15/141* (2013.01); *H01Q 21/00* (2013.01); *H01Q 21/0025* (2013.01); *H01Q 21/08* (2013.01); *H01Q 21/26* (2013.01)

(58) Field of Classification Search
CPC ..... H01Q 1/246; H01Q 1/42; H01Q 9/0478; H01Q 21/0025; H01Q 1/24; H01Q 9/04
USPC ..... 343/702
See application file for complete search history.

(56) References Cited

U.S. PATENT DOCUMENTS

| | | | | |
|---|---|---|---|---|
| 5,845,391 | A * | 12/1998 | Bellus | H01Q 21/0087 343/770 |
| 6,067,053 | A | 5/2000 | Runyon et al. | |
| 6,072,439 | A | 6/2000 | Ippolito et al. | |
| 6,717,555 | B2 | 4/2004 | Teillet et al. | |
| 6,930,651 | B2 | 8/2005 | Gottl et al. | |
| 7,142,821 | B1 | 11/2006 | Mohuchy et al. | |
| 7,679,576 | B2 | 3/2010 | Riedel et al. | |
| 8,115,696 | B2 | 2/2012 | Skalina et al. | |
| 8,154,457 | B2 | 4/2012 | Van Der Poel | |
| 8,164,541 | B2 | 4/2012 | Van Der Poel | |
| 2001/0054983 | A1 | 12/2001 | Judd et al. | |
| 2002/0163476 | A1 | 11/2002 | Eriksson | |
| 2004/0056818 | A1 | 3/2004 | Sledkov | |
| 2004/0201542 | A1 | 10/2004 | Gottl et al. | |
| 2004/0201543 | A1 * | 10/2004 | Gotti | H01Q 1/1207 343/912 |
| 2005/0134517 | A1 * | 6/2005 | Gotti | H01Q 1/246 343/797 |
| 2005/0206575 | A1 | 9/2005 | Chadwick et al. | |
| 2007/0229380 | A1 | 10/2007 | Oota et al. | |
| 2008/0006206 | A1 | 3/2008 | Borau et al. | |
| 2008/0062062 | A1 | 3/2008 | Borau et al. | |
| 2009/0251377 | A1 | 10/2009 | Peng et al. | |
| 2010/0013729 | A1 | 1/2010 | Harel et al. | |
| 2011/0234463 | A1 | 9/2011 | Lankes et al. | |

FOREIGN PATENT DOCUMENTS

| | | |
|---|---|---|
| EP | 1 328 042 | 7/2003 |
| EP | 2 058 901 | 5/2009 |
| WO | 2004/091041 | 10/2004 |

OTHER PUBLICATIONS

Merriam Webster.com, https://www.merriam-webster.com/dictionary/unitary (accessed Sep. 9, 2022).*
Oxford English Dictionary, https://www.oed.com/view/Entry/214755?redirectedFrom=unitary& (accessed Sep. 9, 2022).*
International Search Report, International Application No. PCT/US2010/047157, dated Sep. 18, 2015 (8 pp.).
Written Opinion, International Application No. PCT/US2010/047157, dated Sep. 18, 2015 (11 pp.).

* cited by examiner

MODULAR TYPE CELLULAR ANTENNA ASSEMBLY

CROSS-REFERENCE TO RELATED APPLICATIONS

This application claims priority under 35 U.S.C. § 120 to U.S. patent application Ser. No. 15/425,685, filed Feb. 6, 2017, which in turn claims priority under 35 U.S.C. § 120 to U.S. patent application Ser. No. 13/393,492, filed Jul. 25, 2012, which in turn is a 35 U.S.C. § 371 national stage application of PCT International Application No. PCT/US2010/047157, filed Aug. 30, 2010, which in turn claims priority to U.S. Provisional Patent Application No. 61/238,588, filed Aug. 31, 2009, the entire content of all of which are incorporated herein by reference.

FIELD OF INVENTION

The present invention generally relates to antennas. More particularly, the present invention relates to an antenna assembly formed from a plurality of individually formed modular radiating units.

BACKGROUND

Wireless mobile communication networks continue to evolve given the increased traffic demands on the networks, the expanded coverage areas for service, and the new systems being deployed. Known cellular-type communication systems can consist of a plurality of antenna assemblies, each serving a sector or area commonly referred to a cell, and can be implemented to effect coverage for a larger service area. The collective cells can make up the total service area for a particular wireless communication network.

Known cellular antenna assemblies in mobile communication networks can consist of a single large reflector, feed network, and several radiating elements; these components can be complicated to assemble. While integrating the radiating elements into the single large reflector is possible in theory, it can be difficult do because of tooling expenses and manufacturing difficulty.

The radiating elements can be connected to phase shifters with coaxial cables or with soldering at connection points. When coaxial cables are employed, the cables are manufactured to be the same length so that differences in the physical distance between a phase shifter and a radiating element will not cause unwanted differences in phase relationships. However, because the length of the coaxial cable is not customized for a particular antenna, often radiating elements in the middle of an antenna have excess cable, which must be stowed without violating minimum bend radius requirements.

When soldered connection points are employed, the soldered joints can contribute to phase abnormalities, which are often undesirable. Furthermore, solder joints can represent additional cost, the potential for error during assembly (e.g., a bad joint), and degradation of the longevity of the antenna panel assembly.

Often junctions between transmission lines of the feed network are in a different plane. However, when the feed network is not planar, feed lines can get tangled during transportation or handling on the production line.

In view of the above, improved modular type cellular antenna assemblies are desired. Preferably, such antenna assemblies reduce assembly time and cost while maximizing performance.

SUMMARY OF THE INVENTION

According to one embodiment of the present invention an individually formed modular radiating unit is provided. The radiating unit can include a reflector, at least one radiating element integrated into a first side of the reflector, and a housing disposed on a second side of the reflector. The housing can form a chamber for housing a feed network. At least a portion of the reflector, the radiating element, or the housing can be conductive.

The housing can form a single chamber, and the single chamber can house first and second feed networks. Alternatively, the housing can form a double chamber including a first chamber and a second chamber. In some embodiments, the first and second chambers can be side-by-side, and in some embodiments, the first and second chambers can be stacked upon one another. The first chamber can house a first feed network, and the second chamber can house a second feed network.

In some embodiments, the radiating unit can also include at least one feed balun associated with the at least one radiating element. In some embodiments, the radiating unit can include at least one mechanical fastener, such as a clip or a pin.

According to another embodiment of the present invention, an antenna array is provided. The antenna array can include a plurality of individually formed radiating units assembled together end to end, and each individually formed radiating unit can include a reflector, at least one radiating element integrated into a first side of the reflector, and a housing disposed on a second side of the reflector. The housing can form a chamber for housing a feed network.

In some embodiments, the antenna array can include a junction at a connection point between a first radiating unit and a second radiating unit, and the junction can be a capacitive junction.

At least first and second dielectric sheets can be located on opposing sides of the feed network. In some embodiments, at least one of the first or second dielectric sheets can include at least one sub-sheet formed from a first dielectric material, and at least one sub-sheet formed from a second dielectric material. The sub-sheet formed from the first dielectric material can slide relative to the sub-sheet formed from the second dielectric material.

The antenna array can include at least one phase shift device disposed along a length of the antenna array. In some embodiments, the phase shift device can include a plurality of individual phase shift devices, and each individual phase shift device can be integrated into a respective individually formed radiating unit. In some embodiments, each of the plurality of individual phase shift devices can be linked together.

According to another embodiment of the present invention an antenna assembly is provided. The antenna assembly can include an antenna array formed from a plurality of individually formed radiating units assembled together end to end, and a support structure mounted to a first side of the antenna array. Each individually formed radiating unit can include a reflector, at least one radiating element integrated into a first side of the reflector, and a housing disposed on a second side of the reflector. The housing can form a chamber for housing a feed network.

In some embodiments of the present invention, the antenna, assembly can also include a radome cover affixed to at least a portion of a second side of the antenna array. In some embodiments, the antenna assembly can include a flexible membrane covering at least a portion of the radome cover or the antenna array.

First and second antenna end caps can be disposed at distal ends of the antenna array, and each of the antenna end caps can include an RF input connector.

DETAILED DESCRIPTION

Figure 1A:
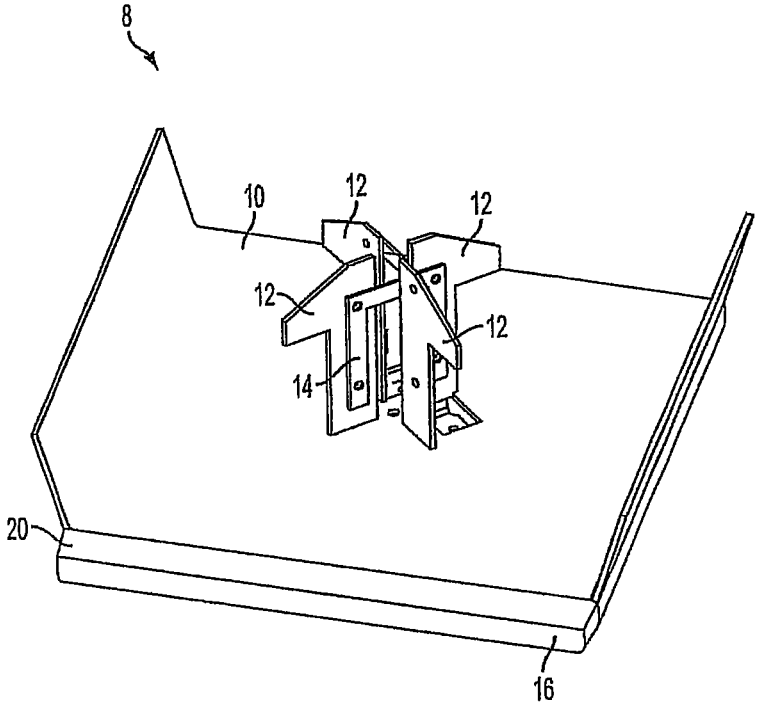
FIG. 1A is a perspective view of an individually formed radiating unit with three integrated sections and a single chamber in accordance with the present invention.

While this invention is susceptible of an embodiment in many different forms, there are shown in the drawings and will be described herein in detail specific embodiments thereof with the understanding that the present disclosure is to be considered as an exemplification of the principles of the invention. It is not intended to limit the invention to the specific illustrated embodiments.

Embodiments of the present invention include an antenna assembly formed from a plurality of individually formed radiating units. Each individually formed radiating unit, or RERH unit, can be a modular unit or component and can include housing components and a reflector coupled to a RF radiator element. In some embodiments, multiple radiator elements can be coupled to each reflector.

Selective coating techniques of conductive coatings, as will be explained herein, can be used to fully integrate a radiating element with a reflector of an individually formed radiating unit. When the radiating element is integrated onto each individual section of the reflector, a joint between the radiating element and the reflector can be eliminated.

In some embodiments, a radiating element can be formed separately and then connected to an individually formed radiating unit to form a desired element and circuit feed structure. In these embodiments, the radiating element can also be formed using selective coating techniques of conductive coatings.

When the radiating element is integrated onto individual sections of reflector, the tooled part size of the antenna can be reduced, and the reusability and volume of the antenna can be maximized. Because the modular units are smaller than complete antenna assemblies known in the art, the cost of tooling the components can be reduced.

In some embodiments, the modular components of the individually formed radiating units can be made out of a single piece of material, for example, metal, using known manufacturing methods, for example, injection molding, casting, compression molding, or the like. In other embodiments, the modular components can be constructed from multiple materials. For example, a low-cost base material can be plated with a reflective material.

When an individually formed radiating unit is constructed from multiple materials, selective sections, surfaces, or portions can be formed to readily conduct radio frequency energy. Then, the conductive portions can form desired circuit paths to feed energy to antenna components.

Conductive portions of can be segregated from non-conductive portions by a two-part molding process, for example, over-molding. Over-molding can be performed in a variety of ways. For example, a first part of the molding can accept a conductive coating, and a second part of the molding can reject the conductive coating. Alternatively, a first part of the molding can be formed with a primarily conductive material, and a second part of the molding can be formed with a primarily non-conductive (dielectric) material.

The conductive and non-conductive portions of the individually formed radiating unit can be segregated from one another by using selective coating techniques of-conductive coatings. For example, the conductive portion can be segregated from the non-conductive portion by insert-molding (over-molding) conductive circuits. In these embodiments, the circuit paths can be formed for metallic or other conductive materials and then over-molded with the non-conductive materials. The circuits can be formed in a single piece and then separated into multiple circuit paths during the over-molding process. Alternatively, the circuits can be formed as separate circuit paths and then joined together during the over-molding process.

Individually formed radiating units, as described above, can be constructed together to form an antenna array. The antenna array can have any length as would be desired by one of skill in the art because any number of radiating units can be constructed together. To facilitate assembly with another unit, an individually formed radiating unit can integrate mechanical features that interface with mechanical features of a second unit. Examples of mechanical features that can join radiating units together include, but are not limited to, mechanical snaps or clips, tracks and slots, or integral receptacles for receiving plug devices.

When individually formed radiating units are assembled together, junctions can form between sections of reflector. In some embodiments, the surface area of the reflectors can overlap, and the overlapping area can be a capacitive junction. Capacitive junctions can reduce phase abnormalities, improve initial build quality, and enhance the longevity of the antenna.

Embodiments of the present invention can include phase shift devices installed along the length of the antenna array. The output of the phase shift devices can be connected to the input of the radiating elements. In embodiments of the present invention, the phase shift devices can be a sliding dielectric type or a rotating wiper type. In some embodiments, the phase shift devices can be local to each radiating element.

Phase shifter circuit paths can be integrated into each individually formed radiating unit and controlled with linkages spanning multiple units. For example, the moving portion of a phase shifter device (wiper) can interface with features integrated into a radiating unit.

In some embodiments, phase shift devices can be linked together to mimic the movements of each other. For example, the moving portion of a phase shift device (wiper) can interface with a linkage for linking to other phase shifter wipers. In these embodiments, multiple phase shift devices can shift at the same rate, if desired. In other embodiments, the linkage may drive the phase shifter devices at rates related by a fixed ratio.

In accordance with the present invention, the need for coaxial cable and/or solder joints to connect the phase shift devices with radiating elements can be reduced because output from the phase shifters can be connected directly to the radiating elements. For example, the phase shift devices can be distributed physically proximate to the radiating elements.

Embodiments of the present invention can also include a planar feed network. For example, a feed network can be constructed using trace conductors contained on a printed circuit board or cut from sheet metal. A junction between the feed network and inputs to the radiating elements can be in a plane parallel to the surface of the plane containing the feed network.

In embodiments of the present invention, feed circuits of the feed network can be formed in sections that encompass and feed a plurality of individually formed units. The feed circuits can be formed using a two-part molding process.

The electrical or phase length of each line from the feed network to the radiating element must be equal or offset by predetermined amounts to form a desired beam. However, the distance from a primary power divider or phase shifter to a radiating element on the outer end of the antenna is longer than the distance to a radiating element in the middle of the antenna.

In embodiments of the present invention, the feed network can be phase adjusted to the correct values so that feed network outputs are connected directly to the radiating elements without the need for phase delay transmission lines between the feed network and radiating elements. In embodiments of the present invention, the phase adjustment of the feed network can be performed with meandering sections of line or dielectric materials with different permittivities.

The use of two or more different dielectric materials can control the phase velocity of energy on the branches of the transmission lines that make up the feed network. For example, transmission lines leading to radiating elements in the middle of the antenna can be physically shortened if a dielectric material with a higher permittivity or dielectric constant is used in connection with those lines. When a shorter line is employed, the number of bends needed to stow that line can be minimized.

During the assembly of an individually formed radiating unit in accordance with the present invention, feed circuit paths can be selected by forming the radiating unit with multiple receptacles that can be configured and used with conductive plugs to form unique circuits when joined together in various combinations. For example, using the receptacle of the radiating unit and a conductive plug, circuits can be selected or deselected. Non-conductive plugs can also be used. In this manner, each individually-formed radiating unit can be manufactured identically, but different radiating units can perform different functions based on the feed circuit path selected.

Once assembled together, an antenna array in accordance with the present invention can be mounted to a support structure. For example, mounting features or brackets can be formed as part of a reflector, can interface with a reflector, can interface with a spine member that spans the assembled radiating units, or can be integrated with the spine unit itself.

Individually formed radiating units, as described above, can also be formed with integral features to accept a radome or other antenna housing as would be known in the art. For example, an individually formed radiating unit can be formed with a slide, snap, track, groove or other feature for accepting the radome. In some embodiments, a radome can span the entire length of an array antenna made of a plurality of radiating units constructed together. In some embodiments, the radome can span individual radiating units or a subset of radiating units.

A radome in accordance with the present invention can be formed as a solid uniform material. Alternatively, a radome can be formed with hollow features in cross section. In these embodiments, the hollow features can decrease the weight of the antenna while improving dielectric properties and, therefore, improving antenna performance.

The hollow features of a radome cover can be formed as a one piece construction, such as extruding polymers with an outer skin, inner skin, and connecting members forming linear hollow chambers. Alternatively, the hollow features of a radome can be formed using known composite sandwich panel methods, such as bonding outer and inner skins around honeycomb-like material. In still further alternative embodiments, partially hollow radome covers can be formed by injecting gas during formation to create random or predictable hollow pockets in the material walls.

In some embodiments of the present invention, the radome can be covered by a flexible membrane to enhance the structural integrity and weather resistant capabilities of the antenna array. The flexible membrane can be stretched over the radome and/or the antenna to form a drum-like structure. Alternatively; the flexible membrane can include an adhesive side for applying to antenna surfaces directly. In still further alternative embodiments, the flexible membrane can be secured by mechanical features associated with the antenna components.

According to the present invention, the flexible membrane can overlap the radome completely to form an enclosed barrier around the antenna. Thus, the antenna can be sealed from the elements. In some embodiments, the flexible membrane can wrap around itself to form the seal. In some embodiments, the flexible membrane can include graphics on the exterior thereof for changing the look of the antenna. The graphics can be conductive, thereby impacting antenna performance and radiation patterns.

The individually formed radiating units can be formed to interface with antenna end caps that attach mechanically to radiating units at distal ends of an antenna array. In accordance with the present invention, the antenna end caps can enclose the antenna array and provide connectivity. To provide connectivity in field use, the antenna end caps can be formed with integral RF input connectors. In some embodiments, the input connectors can be conductive by over-molding or using selective coating techniques of conductive coatings, as described above. In some embodiments, the input connectors can be formed separately and integrated during formation of the antenna end cap.

Figure 1B:
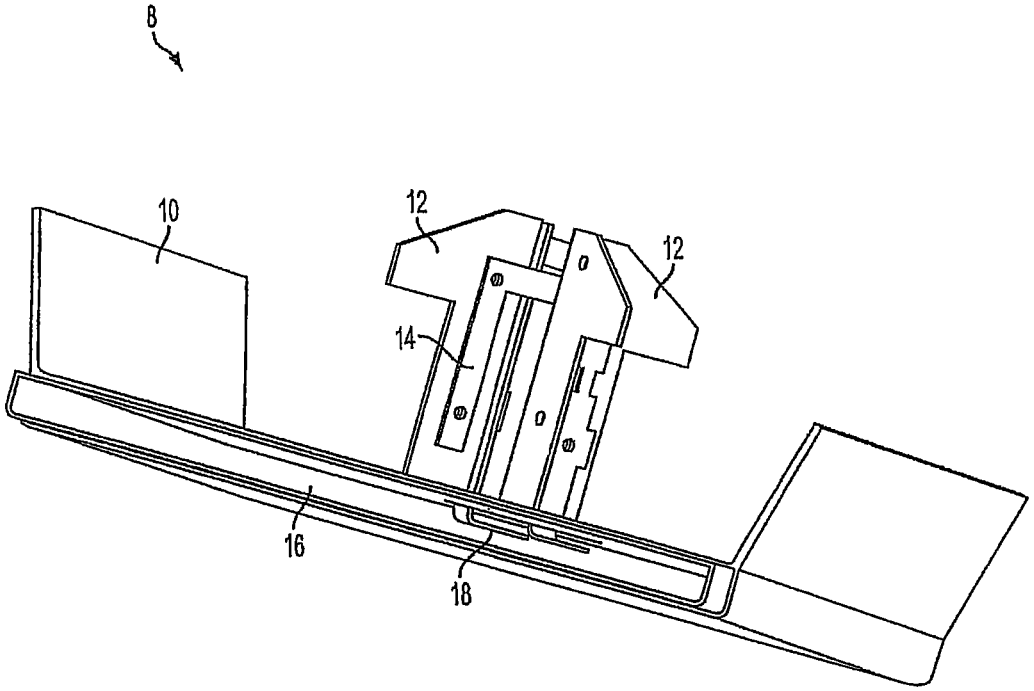
FIG. 1B is a side view of an individually formed radiating unit with three integrated sections and a single chamber in accordance with the present invention.

FIG. 1A is a perspective view of an individually formed radiating unit 8 with three integrated sections and a single chamber in accordance with the present invention, and FIG. 1B is a side view of the radiating unit 8 shown in FIG. 1A. The three integrated sections include a reflector 10, a radiating element 12, and a chamber 16 for housing a power distribution network 18.

As seen in FIGS. 1A and 1B, a section of reflector 10 shapes the azimuth pattern of a linear array, and a radiating element 12 is integrated into the top surface of the reflector 10. Because the radiating element 12 is integrated into the reflector 10, the need for fasteners is eliminated. In some embodiments, the radiating element 12 can include one or more elements for one or more frequency bands. Feed baluns 14 are separate but connected to the radiating element 12.

As best seen in FIG. 1B, a chamber 16 below the reflector 10 houses the power distribution network 18 (feed network), and the chamber 16 forms a double ground plane of a stripline transmission structure. In the embodiment shown in FIG. 1B, the feed network 18 is enclosed, which can reduce stray radiation and improve isolation performance and gain.

The radiating unit 8 shown in FIGS. 1A and 1*b* can be conductive at least on the surface thereof. For example, the unit 8 could be solid metal or metalized plastic.

Junctions between the elements shown in FIGS. 1A and 1B can be capacitive so that metal parts need not be soldered. For example, the unit 8 could be formed from non-solderable aluminum, which is typically less expensive than, for example, copper or silver.

Joints 20 can be included at either or both open ends of the radiating unit 8 to facilitate connecting the unit 8 to a second radiating unit. The joints 8 are formed so that a metal surface of a first radiating unit overlaps with a metal surface of a second radiating unit when connected together. If one of the overlapping surfaces is coated with a non-conductive material, then the junction between the first and second radiating units can be a capacitive junction. When large surface areas of the two radiating units are in contact with one another, impedance can be kept to a minimum.

In some embodiments the joints 20 can include fastener features, such as clips or pins to facilitate attaching a first radiating unit 8 to a second radiating unit. Fastener features can stabilize the junction between two radiating units and keep them connected when, for example, the units are under vibrational stress. Fastener features can also be used for aligning the first radiating unit 8 with the second radiating unit 8.

Figure 2:
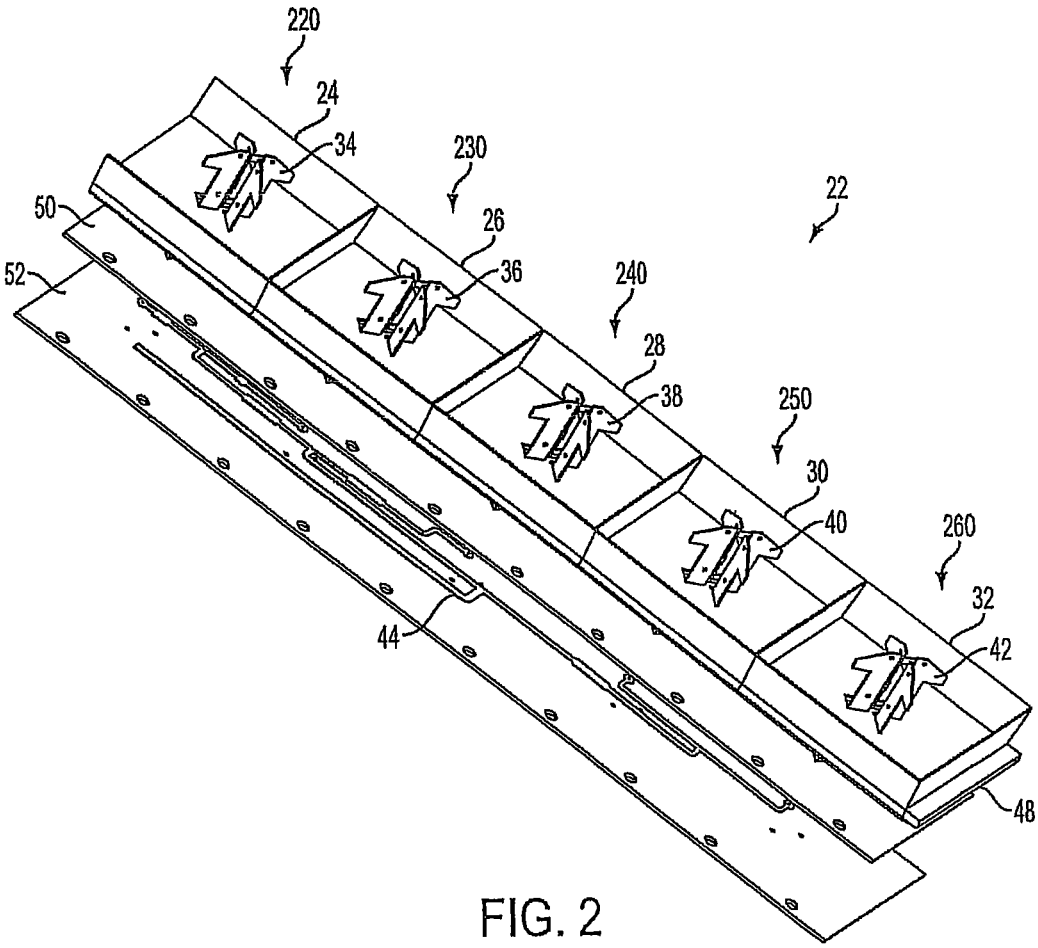
FIG. 2 is an exploded view of an antenna assembly constructed from the modular structures shown in FIGS. 1A and 1B in accordance with the present invention.

FIG. 2 is an exploded view of an antenna assembly 22 constructed from the modular structures shown in FIGS. 1A and 1B in accordance With the present invention. As seen in FIG. 2, a plurality of modular individually formed radiating units 220, 230, 240, 250, and 260 can be assembled together to form an antenna array. Each unit 220, 230, 240, 250, or 260 can include a reflector section 24, 26, 28, 30, or 32, and each reflector section 24, 26, 28, 30, or 32 can be associated with one dual polarized radiating element 34, 36, 38, 40, or 42, respectively.

Two feed networks 44 and 46 can be associated with the radiating elements 34, 36, 38, 40, and 42, one feed network for each polarization. The feed networks 44 and 46 can be enclosed in a chamber 48 formed by the radiating units 220, 230, 240, 250, and 260, and the output arms of the feed networks 44 and 46 can connect capacitively to baluns associated with each radiating element 34, 36, 38, 40, and 42.

The antenna assembly 22 can include two dielectric sheets 50 and 52 to keep the feed networks 44 and 46 centered so that impedance is constant. A first dielectric sheet 50 can be positioned above the feed networks 44 and 46, and the second dielectric sheet 52 can be positioned below the feed networks 44 and 46.

Although not shown in FIG. 2, the antenna assembly 22 can also include fasteners that are part of a capacitive junction and allow for alignment errors between the ends of the feed networks 44 and 46 and the baluns of the radiating elements 34, 36, 38, 40, and 42. Thin, non-conductive gaskets can prevent contact between conductive and non-conductive parts, and rivets can hold conductive parts together to minimize the impedance of capacitive junctions.

Figure 3A:
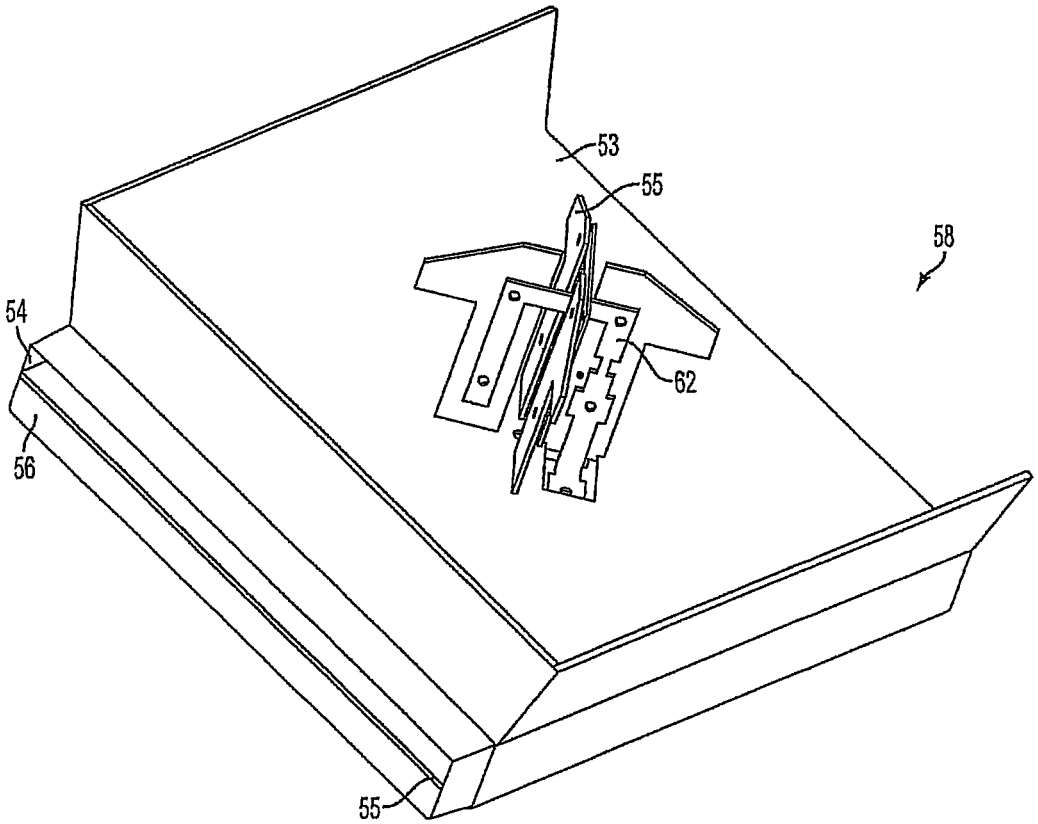
FIG. 3A is a perspective view of an individually formed radiating unit with three integrated sections and double chambers in accordance with the present invention.
Figure 3B:
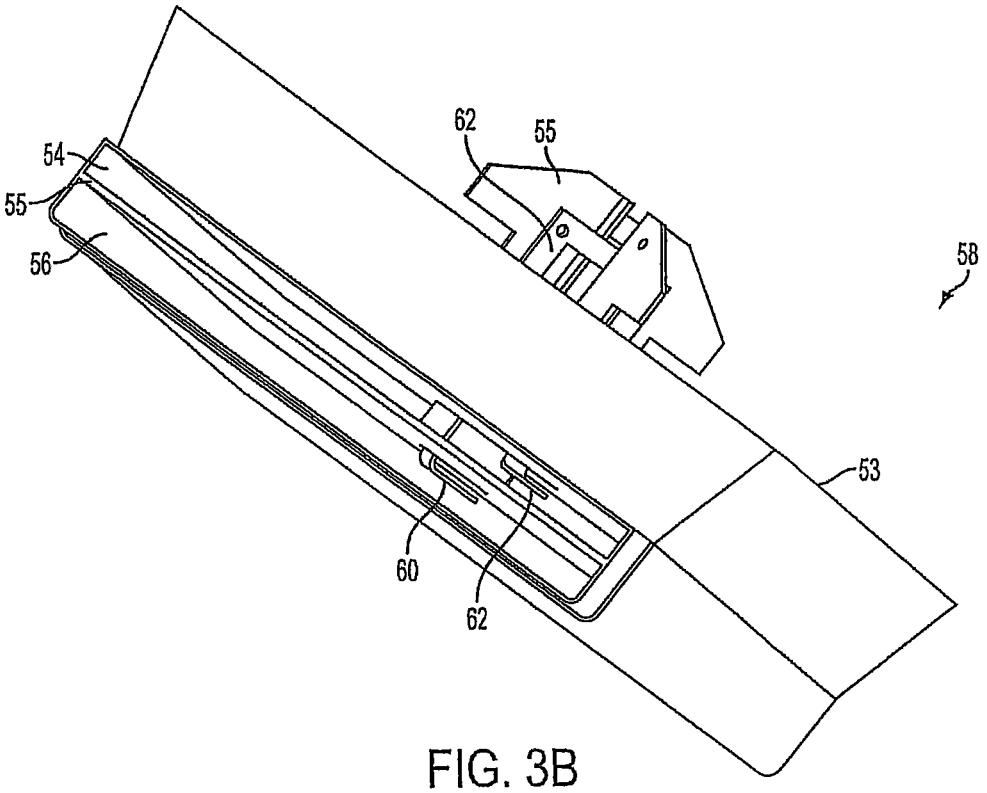
FIG. 3B is a side view of an individually formed radiating unit with three integrated sections and double chambers in accordance with the present invention.

FIG. 3A is a perspective view of an individually formed radiating unit 58 with three integrated sections and double chambers in accordance with the present invention, and FIG. 3B is a side view of the radiating unit 58 shown in FIG. 3A. The radiating unit 58 shown in FIGS. 3A and 3B is similar to the radiating unit 8 shown in FIGS. 1A and 1B, except that the radiating unit 58 includes two chambers 54 and 56. Each chamber 54 and 56 houses a separate feed network. The separate chambers 54 and 56 provide increased isolation between the two feed networks and allow each feed network to extend across the full width of its respective chamber.

The radiating unit 58 can also include additional sections to short circuit connections between the reflector layer 53 and the layer 55 separating the chambers 54 and 56. As best seen in FIG. 3B, radiating element baluns 60 and 62 are housed in respective chambers 54 and 56. The additional sections allow a balun 60 from one polarization to extend through the upper chamber 54 to the lower chamber 56 without a distortion in impedance.

Figure 4:
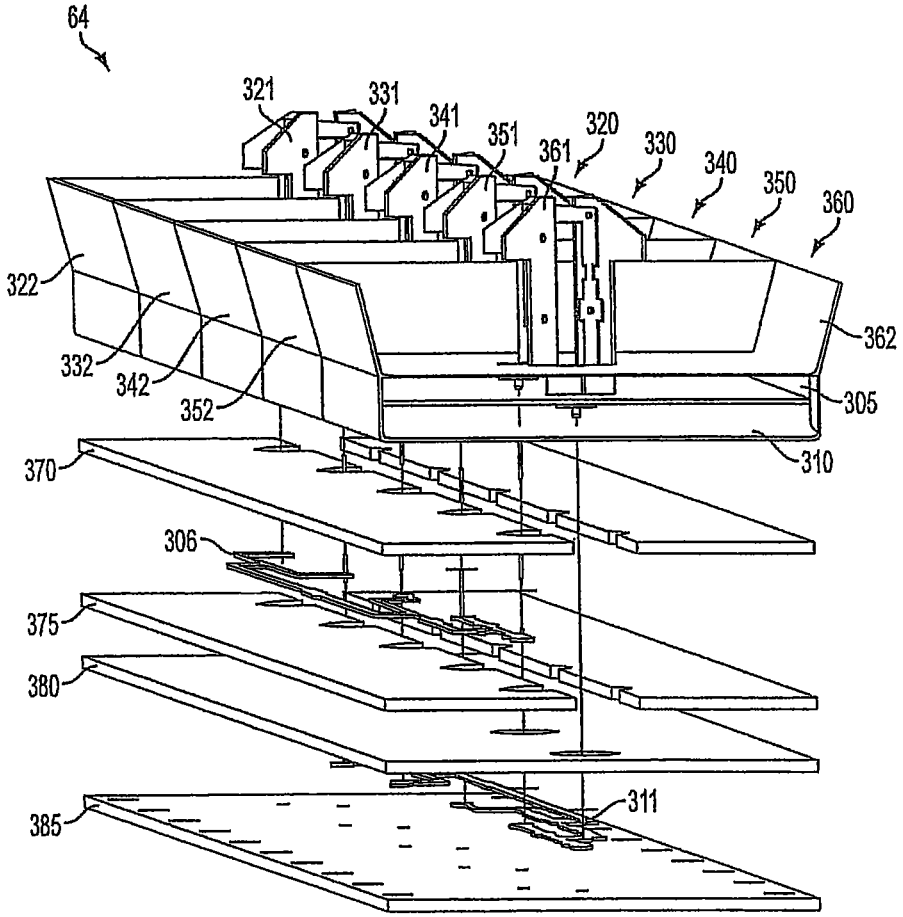
FIG. 4 is an exploded view of an antenna assembly constructed from the modular structures shown in FIGS. 3A and 3B in accordance with the present invention.

FIG. 4 is an exploded view of an antenna assembly 64 constructed from the modular structures shown in FIGS. 3A and 3B in accordance with the present invention. As seen in FIG. 4, a plurality of modular individually formed radiating units 320, 330, 340, 350, and 360 can be assembled together to form an antenna array. Each unit 320, 330, 340, 350, or 360 can include a reflector section 322, 332, 342, 352, or 362, and each reflector section 322, 232, 342, 352, or 362 can be associated with one dual polarized radiating element 321, 331, 341, 351, or 361, respectively.

A first chamber 305 can house a first feed network 306, and a second chamber 310 can house a second feed network 311. Dielectric sheets 370 and 375, and 380 and 385, can be situated on opposing sides of the feed networks 306 and 311, respectively.

Figure 5:
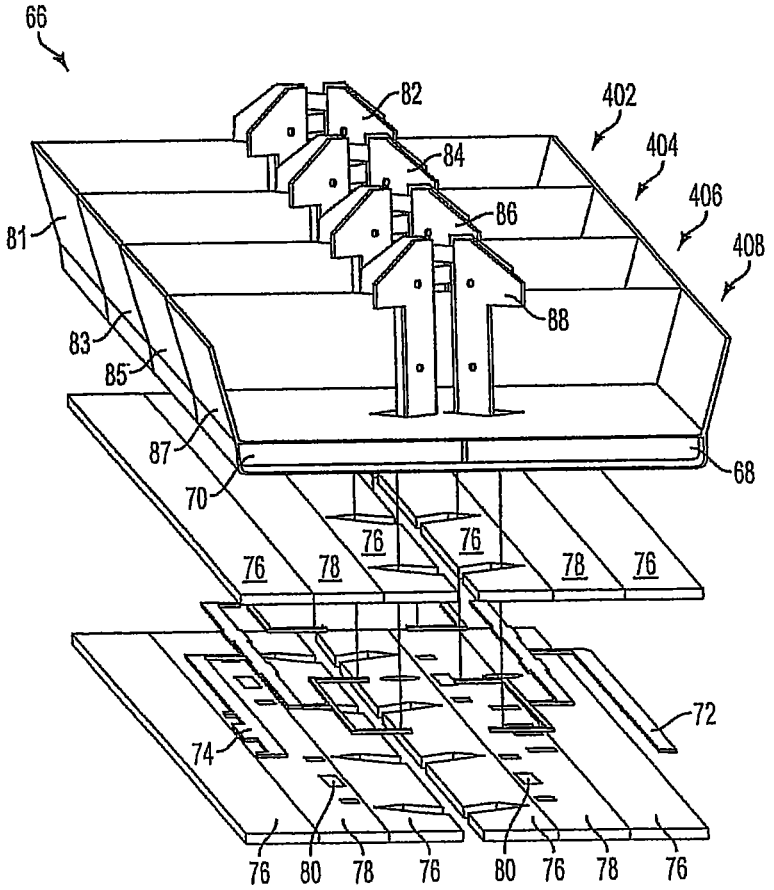
FIG. 5 is an exploded view of an antenna assembly constructed from individually formed radiating units with double side-by-side chambers in accordance with the present invention.

FIG. 5 is an exploded view of an antenna assembly 66 constructed from individually formed radiating units with double side-by-side chambers in accordance with the present invention. As seen in FIG. 5, the antenna array assembly 66 includes a plurality of modular radiating units 420, 404, 406, and 408 assembled together to form an antenna array. Each unit 402, 404, 406, or 408 can include a reflector section 81, 83, 85, or 87, and each reflector section 81, 83, 85, or 87 can be associated with one dual polarized radiating element 82, 84, 86, or 88, respectively.

Two separate side-by-side chambers 68 and 70 can be located below the radiating units 402, 404, 406, and 408, and each chamber 68 and 70 can house a separate feed network 72 and 74, respectively. The side-by-side orientation of the chambers 68 and 70 can provide improved isolation between the polarizations of the feed networks 72 and 74.

Three dielectric materials 76, 78, and 80 are included in the antenna assembly 66 in FIG. 5. Sheets made of the first dielectric material 76 are in a fixed position, and sheets made of the second dielectric material 78 include small areas made of the third dielectric material 80.

Sheets made of the second and third dielectric materials 78 and 80 can slide back and forth relative to the power divider junctions in the feed networks 72 and 74. The movement can cause a relative phase change in the signals traveling down different branches of the feed networks 72 and 74, and the phase change can cause a beam formed by the collection of radiating elements 82, 84, 86, and 88 to scan in space.

Figure 6A:
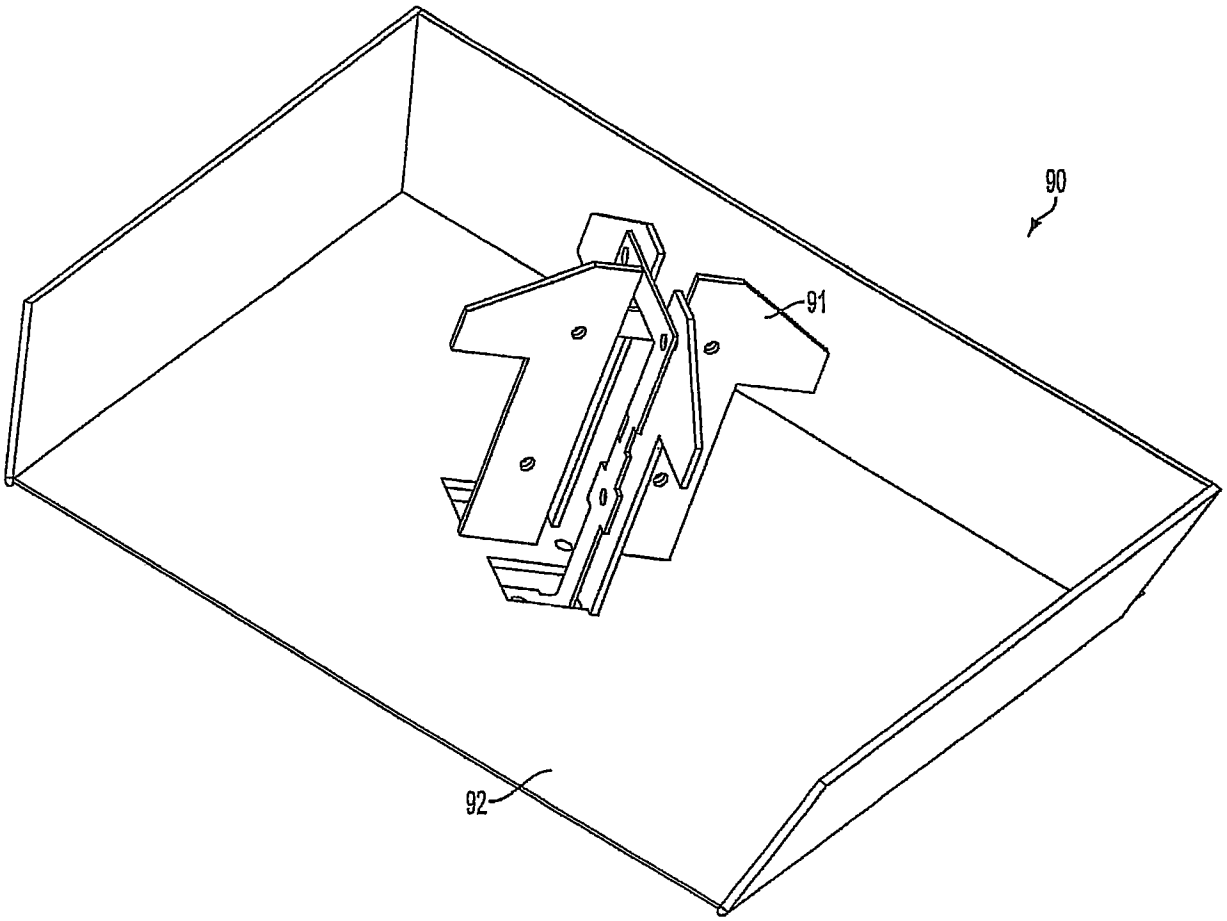
FIG. 6A is a perspective view of an individually formed radiating unit with three integrated sections and a single ground plane in accordance with the present invention.
Figure 6B:
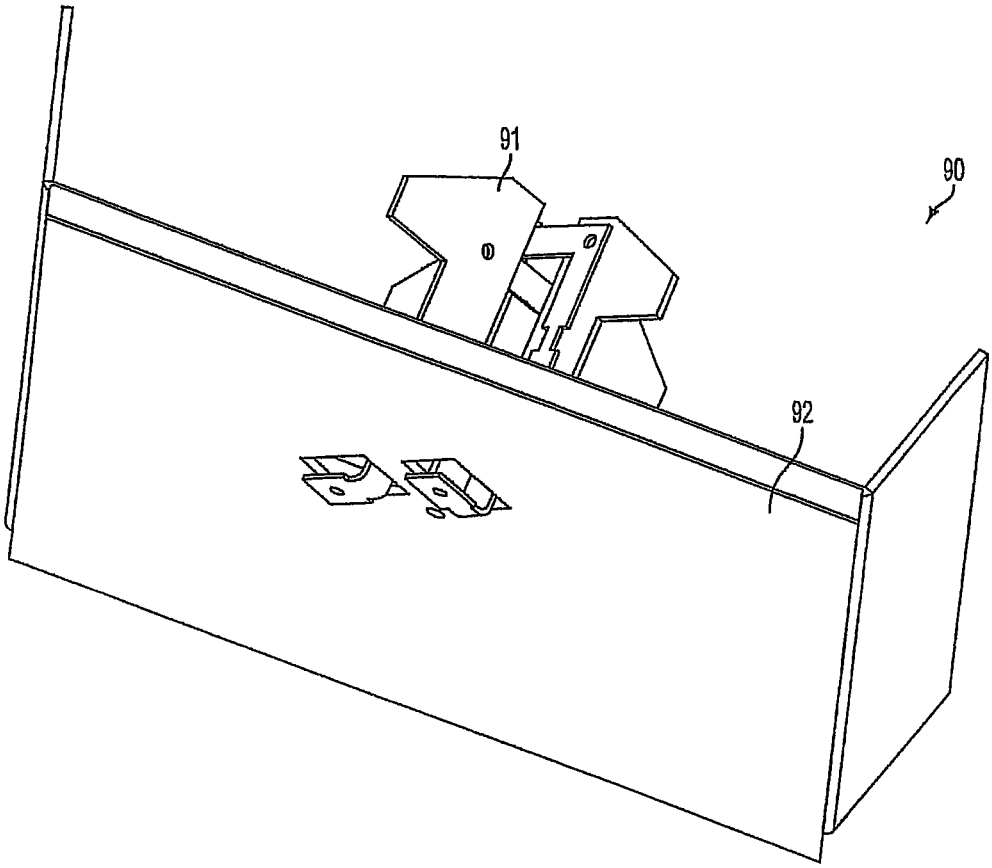
FIG. 6B is a side view of an individually formed radiating unit with three integrated sections and a ground plane in accordance with the present invention.

FIG. 6A is a perspective view of an individually formed radiating unit 90 with three integrated sections and a single ground plane 92 in accordance with the present invention, and FIG. 6B is a side view of the radiating unit 90 shown in FIG. 6A. While the structure of the radiating unit 90 is simplified as compared to other radiating units shown and described above, in the radiation unit 90, radiation by the two feed networks is possible, and coupling between the feed networks is possible. Furthermore, because two ground planes are not employed, fasteners must be employed to secure the feed network in place relative to the ground plane of the reflector 92.

Figure 7:
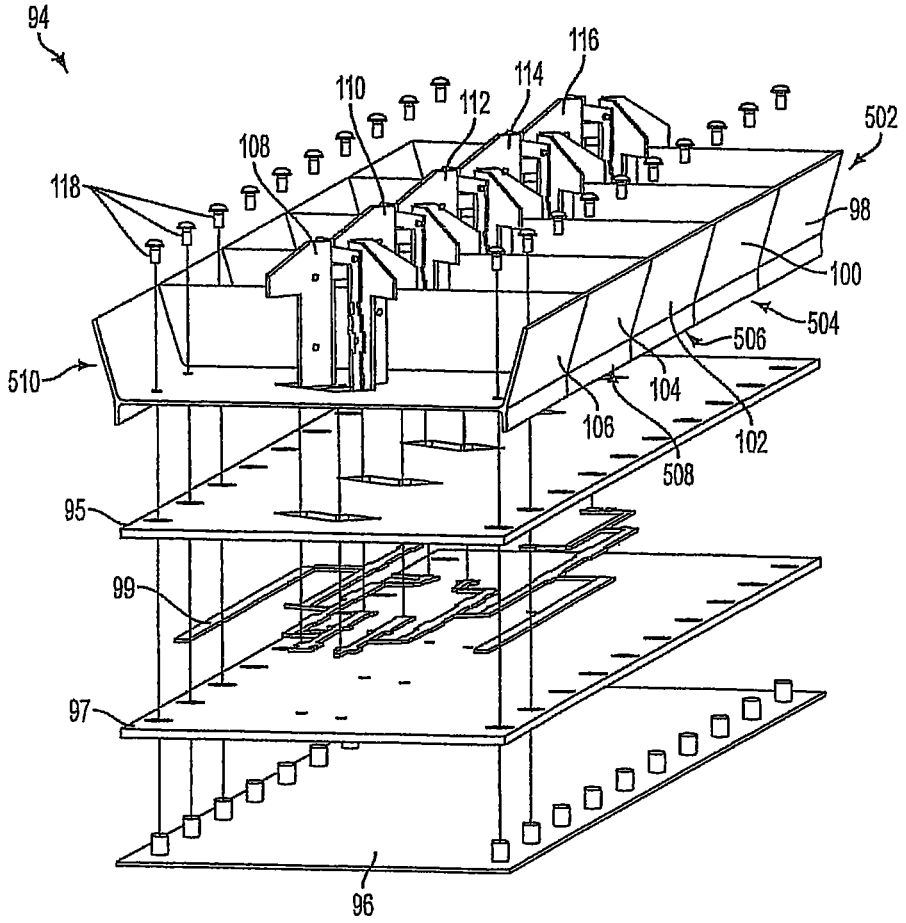
FIG. 7 is an exploded view of an antenna array assembly constructed from radiating units with an H-type configuration in accordance with the present invention.

FIG. 7 is an exploded view of an antenna array assembly 94 constructed from radiating units with an H-type configuration in accordance with the present invention. As seen in FIG. 7, a plurality of modular radiating units 502, 504, 506, 508, and 510 can be assembled together to form an antenna array. Each unit 502, 504, 506, 508, or 510 can include a reflector section 98, 100, 102, 104, or 106, and each reflector section 98, 100, 102, 104, or 106 can be associated with one dual polarized radiating element 116, 114, 112, 110, or 108, respectively. The second ground plane 96 of the antenna assembly 94 is a separate part relative to the modular unites 502, 504, 506, 508, and 510 that contain the radiating elements 116, 114, 112, 110, and 108.

The structure of the modular radiating units 502, 504, 506, 508, and 510 is simplified as compared to other radiating elements shown and described above, and access to feed networks 99 during assembly is improved. However, the second ground plane 96 requires that the reflectors 98, 100, 102, 104, and 106 of the modular units 502, 504, 506, 508, and 510 are connected to yet another part via connectors 118.

From the foregoing, it will be observed that numerous variations and modifications maybe effected without departing from the spirit and scope of the present invention. It is to be understood that no limitation with respect to the specific system or method illustrated herein is intended or should be inferred. It is, of course, intended to cover by the appended claims all such modifications as fall within the spirit and scope of the claims.

That which is claimed is:

1. An antenna array comprising:

a plurality of separate, individually formed modular radiating units, each modular radiating unit comprising a reflector and a radiating element disposed on a first side of the reflector, wherein each radiating element is a dual-polarized radiating element that is composed of a single unitary non-conductive, non-planar molding having a conductive coating selectively formed thereon, and wherein each radiating element is unitary with the reflector of its modular radiating unit, and wherein a feed network is on a second side of the reflector that is opposite the first side of the reflector.

2. The antenna of claim 1, wherein each modular radiating unit further includes a housing disposed on a second side of the reflector.

3. The antenna array of claim 2, wherein respective housings of the plurality of modular radiating units are linked together to form at least one chamber.

4. The antenna array of claim 3, wherein reflectors of respective ones of the plurality of modular radiating units overlap to form capacitive junctions between adjacent modular radiating units.

5. The antenna array of claim 1, wherein no joint is formed between the radiating element and the reflector of each modular radiating unit.

6. The antenna array of claim 1, wherein each modular radiating unit comprises metallized plastic.

7. The antenna array of claim 1, wherein the reflector of each modular radiating unit includes first and second sidewalls, and the radiating element of each modular radiating unit is mounted between the first and second sidewalls of the reflector of its modular radiating unit.

8. The antenna array of claim 1, wherein the radiating units are assembled end-to-end.

9. The antenna array of claim 1, further comprising a capacitive junction between a first of the radiating units and a second of the radiating units.

10. An antenna array comprising:

a plurality of separate, individually formed modular radiating units, each modular radiating unit comprising a reflector and a radiating element disposed on a first side of the reflector; and a phase shifter that includes a plurality of outputs, wherein each radiating element is a dual-polarized radiating element that comprises a unitary non-conductive, non-planar molding having a conductive coating selectively formed thereon, and wherein each radiating element is integral with the reflector of its modular radiating unit, and wherein the outputs are connected directly to respective ones of the radiating elements and wherein the phase shifter comprises a plurality of individual phase shift devices, and each individual phase shift device is integrated into a respective one of the modular radiating units.

11. The antenna array of claim 10, wherein reflectors of respective ones of the plurality of modular radiating units overlap to form capacitive junctions between adjacent modular radiating units.

12. The antenna array of claim 10, wherein the reflector of each modular radiating unit includes first and second sidewalls, and the radiating element of each modular radiating unit is mounted between the first and second sidewalls of the reflector of its modular radiating unit.

13. The antenna array of claim 10, wherein no joint is formed between the radiating element and the reflector of each modular radiating unit.

14. An antenna array comprising:

a plurality of separate, individually formed modular radiating units, each modular radiating unit comprising a reflector, a dual-polarized radiating element disposed on a first side of the reflector and a feed network disposed on a second side of the reflector, wherein the reflector and the dual-polarized radiating element of each modular radiating unit are implemented together as a single unitary non-conductive, non-planar molding having a conductive coating selectively formed thereon, wherein the plurality of modular radiating units are connected together to form the antenna array.

15. The antenna array of claim 14, wherein reflectors of respective ones of the plurality of modular radiating units overlap to form capacitive junctions between adjacent modular radiating units.

16. The antenna array of claim 14, wherein no joint is formed between the radiating element and the reflector of each modular radiating unit.

17. The antenna array of claim 14, wherein each modular radiating unit comprises metallized plastic.

18. The antenna array of claim 14, further comprising a phase shifter that includes a plurality of outputs, wherein the outputs are connected directly to respective ones of the radiating elements.

19. The antenna array of claim 14, wherein the reflector includes first and second sidewalls, and the radiating element is mounted between the first and second sidewalls.

* * * * *